United States Patent [19]

Mangialardi, Jr.

[11] 4,253,215

[45] Mar. 3, 1981

[54] LINT CLEANING APPARATUS FOR AUTOMATIC CONTROL OF COTTON QUALITY

[75] Inventor: Gino J. Mangialardi, Jr., Greenville, Miss.

[73] Assignee: The United States of America, as represented by the Secretary of Agriculture, Washington, D.C.

[21] Appl. No.: 14,407

[22] Filed: Feb. 23, 1979

Related U.S. Application Data

[63] Continuation-in-part of Ser. No. 866,077, Dec. 30, 1977, abandoned.

[51] Int. Cl.[3] ..... D01B 1/00

[52] U.S. Cl. ..... 19/66 CC; 19/202

[58] Field of Search ..... 19/66 R, 66 CC, 65 A, 19/200, 202

[56] References Cited

U.S. PATENT DOCUMENTS

| | | | |
|---|---|---|---|
| 3,108,332 | 10/1963 | Moss et al. | 19/202 |
| 3,280,474 | 10/1966 | Van Doorn et al. | 19/66 CC |
| 3,363,286 | 1/1968 | Scott et al. | 19/66 CC |

*Primary Examiner*—Louis Rimrodt

*Attorney, Agent, or Firm*—M. Howard Silverstein; Raymond C. Von Bodungen; David G. McConnel

[57] ABSTRACT

A plurality of lint cotton quality measurements is made on lint cotton which is to be fed into the lint cleaning process in a cotton ginning system. The plurality of cotton quality measurements in the form of individual electrical signals is communicated to a synchronizing means which translates the quality electrical signals into a single electrical output signal fed into a controller which controls the flow of lint cotton into the lint cleaning apparatus.

9 Claims, 8 Drawing Figures

LINT CLEANING APPARATUS FOR AUTOMATIC CONTROL OF COTTON QUALITY

CROSS REFERENCE

This is a continuation-in-part of application Ser. No. 866,077, filed Dec. 30, 1977, now abandoned.

BACKGROUND OF THE INVENTION

1. Field of the Invention

This invention relates to automatically controlling the feed of lint cotton in a ginning process. More specifically, the lint cotton quality is measured and the feed of the lint cotton to the ginning process is adjusted accordingly.

2. Description of Prior Art

Automatically controlling the quality of cotton as it passes through the lint cleaning system without interrupting cotton flow through the ginning process has long been sought after by the growers, ginners, and spinners of cotton. Successful and efficient automatic control of cotton quality in the lint cleaning system can result in significant increases in high grade, longer fiber length, low nep count, and high bale weight cotton. Inevitably, this will translate into high bale value and low mill spinning cost.

Lint cleaning decreases trash content in the cotton and affects spinning performance. Increasing the amount of lint cleaning at the cotton gin reduces the amount of picker and card waste at the spinning mill. However, increased lint cleaning causes a greater number of neps in the card web, decreases yarn strength, and lowers yarn appearance, all of which reduce cotton value. Neps detract from the appearance of the material because they absorb dyes differently and appear as spots; low yarn strength, which is related to poor spinning and weaving performance, decreases the usefulness of a given cotton; and poor yarn appearance lowers the quality in many types of fabrics. (*How Many Lint Cleaners Should You Use?*, Mangialardi, Gino J., Jr., Cotton Ginners' Journal & Yearbook, March 1976.)

Increasing the number of lint cleaners also improves the grade classification which is a composite of the cotton's color and foreign-matter content, reduces fiber length, and increases the amount of waste material removed. Since bale value is based on the cotton's grade and staple length and the bale's weight, the addition of an extra lint cleaner will not necessarily give an increase in bale value but could give a bale value decrease. This would be the case when the weight removed and staple length reduction obtained by the use of the additional cleaner offsets the grade improvement. The number of lint cleaners required to give maximum bale value would be dependent upon the condition of the lint cotton before lint cleaning. In general, the early season harvested clean cottons would require less cleaning than the late season harvested more trashy cottons. (*Multiple Lint-Cotton Cleaning: Its Effect on Bale Value, Fiber Quality, and Waste Composition,* Mangialardi, Gino, J., Jr., Technical Bulletin No. 1456, August 1972.)

The grower is interested in producing the type of cotton that will yield the maximum bale value that will be consistent with satisfactory spinning performance. These two factors are controlled somewhat by prices and mill requirements. Based on prices when premiums for grade are small, attainment of maximum bale value depends on the ginner's ability to select the correct amount of lint cleaning. The number of cleanings should be applied to machine-harvested cotton to reduce its trash level only to the extent that will be consistent with highest returns.

Experiments have indicated that some cottons would require a degree of cleaning that would not be available with full stages of lint cleaning. For example, on a particular cotton maximum bale value might be obtained when using an amount of lint cleaning equivalent to a level between one and two stages.

Loading lint cleaners with cotton in the proper manner is one prerequisite to quality control during ginnery operation. This may be achieved by properly adjusting those factors related to loading. Two of these primary factors which affect batt conditions and could be controlled at the gin are lint feed rate and the cotton batt density.

Lint fed to the cleaning machinery at high rates results in decreased cleaning efficiency and produces lower bale values. Experiments show that decreasing these feed rates will give high significant increases in cleaning efficiency, higher grades, and some bale value increases, while causing no significant detrimental effect on fiber length, strength, or nep formation.

Lint batts fed to lint cleaners at high densities result in decreased cleaning efficiency and produce lowered bale values. Poor batt condition can also cause chokages and damage the equipment. (*Effects of Feed Rate and Batt Density on Operation of Saw-Cylinder Lint Cleaners,* Mangialardi, Gino J., Jr., Production Research Report No. 156, U.S. Dept. Agr., November 1974.)

Increase of mechanical action in cleaners by increasing the saw speed or combing ratio or both results in an increase in the cleaning efficiency and higher grades but also produces shorter staple length, an increase in the percent of short fibers, and an increase in the nep count level. Recommendations on saw speeds and combing ratios have to be a compromise between cleaning and fiber breakage. (*Saw-Cylinder Lint Cleaning at Cotton Gins, Effects of Saw Speed and Combing Ration on Lint Quality,* Mangialardi, Gino J., Jr., Technical Bulletin No. 1418, U.S. Dept. Agr., November 1970.)

It has been shown that as the moisture content of the lint increases the fibers become stronger and fewer fibers are broken by the lint cleaning actions. However, these moisture levels are also accompanied by decreased cleaning action. Thus, results show that the higher moisture cottons could and should be processed at higher saw speed or combining ratio or both for increased cleaning while the drier cotton, the fiber being more susceptible to damage, should receive the more gentle action at reduced saw speed and combining ratio. (*Lint Cleaning at Cotton Gins: Effects of Fiber Moisture and Amount of Cleaning on Lint Quality,* Mangialardi, Gino J., Jr., and Griffin, Anselm C., Jr., Technical Bulletin No. 1359, U.S. Dept. Agr., August 1966.)

Research experiments have shown that when premiums for grade are small maximum bale value can be best obtained by adjusting the degree of cleaning to produce cotton grade designation of Strict Low Middling White. It has been demonstrated that classer's grade should be given priority in controlling the degree of cleaning. Mass rate of flow of the cotton appears to be next in importance, followed by the moisture content, in controlling the amount of foreign matter extracted and thus the cotton's grade and bale weight.

Cottons processed at commercial cotton ginning plants are usually subjected to lint cleaning prior to baling. Lint cleaners used are principally of the controlled-batt saw type. In the average gin, cotton can be subjected to none, one, two, or three stages of lint cleaning. The ginner usually can select manually the number of lint cleaners to be used, based on his judgment as to the type and condition of cotton he believes he is processing. He has no control over saw speed, combing ratio, or lint batt density. These are set by the manufacturer at a constant speed and density. All cottons received at the gin plant normally receive the same lint cleaning treatment, although part of the lint-cleaning system is sometimes manually by-passed.

SUMMARY AND OBJECTS OF THE INVENTION

A plurality of quality measurements are made on lint cotton prior to feeding it into the lint cleaning apparatus of a ginning process. These measurements are translated into electrical signals and relayed to a synchronizing unit which selects and converts them into a single electrical output signal. This signal is sent to a controlling device which either feeds the lint cotton into the lint cleaning apparatus or sends it through a by-pass for baling.

It is the primary object of this invention to control the quality of fiber produced in a fiber processing system.

It is another object of the invention to automatically or manually control the quality of lint cotton produced in the lint cleaning process in a cotton gin.

It is another object of the invention to control the classers grade designation of ginned cotton.

It is another object of the invention to control the foreign matter content of ginned cotton.

It is another object of the invention to control the thickness of the cotton batt during the lint cleaning process.

It is another object of the invention to control the length of the fibers produced in a ginning process.

It is another object of the invention to control the nep count in the gin lint.

It is another object of the invention to control the lint cleaning process sufficiently to improve the spinnability of lint used in a milling operation.

It is another object of the invention to control the number of lint cleaners used automatically at a gin.

It is another object of the invention to control the speed of the internal rotating parts of a lint cleaning operation either individually or collectively in any combination.

It is another object of the invention to control automatically the saw cylinder speed of the lint cleaner.

It is another object of the invention to control the combing ratio automatically during the cleaning process.

Other objects of the invention will become obvious from the detailed description of the preferred embodiments of the invention.

This invention distinguishes over the prior art in that the invention automatically makes lint cleaner adjustments based on the quality of cotton to be cleaned and the quality of cotton obtained as a result of these adjustments. The inventor is not aware of nor has been able to find any gin which uses or any patent which claims a system (1) whereby lint cleaner adjustments are made automatically based on automatic measurements of cotton color, foreign matter content, and fiber length with the purpose of controlling any or all of these qualities, (2) which can make additional quality corrections based on the cotton's mass flow rate and moisture content, (3) which can make automatic lint-cleaner adjustments to obtain maximum bale values, (4) which can automatically by-pass the lint cleaners or send cotton to one or more of these cleaners based on automatic quality measurements, and (5) which can make lint-cleaner adjustments by automatic control of saw-cylinder speed and combing ratio.

DETAILED DESCRIPTION OF THE INVENTION

Figure 1:
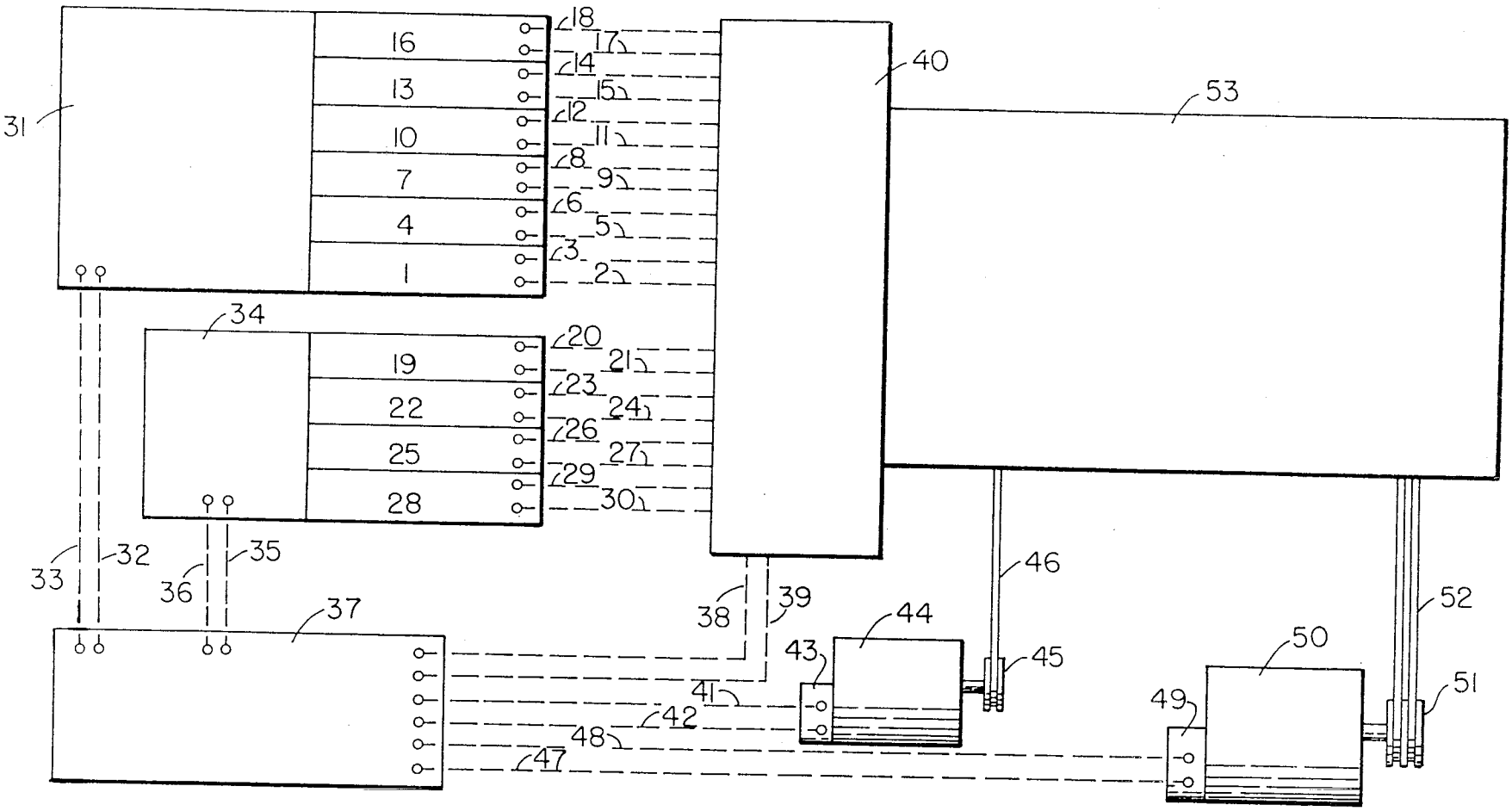
FIG. 1 is a schematic diagram describing a lint cleaner with its driving mechanisms and controls.
Figure 2:
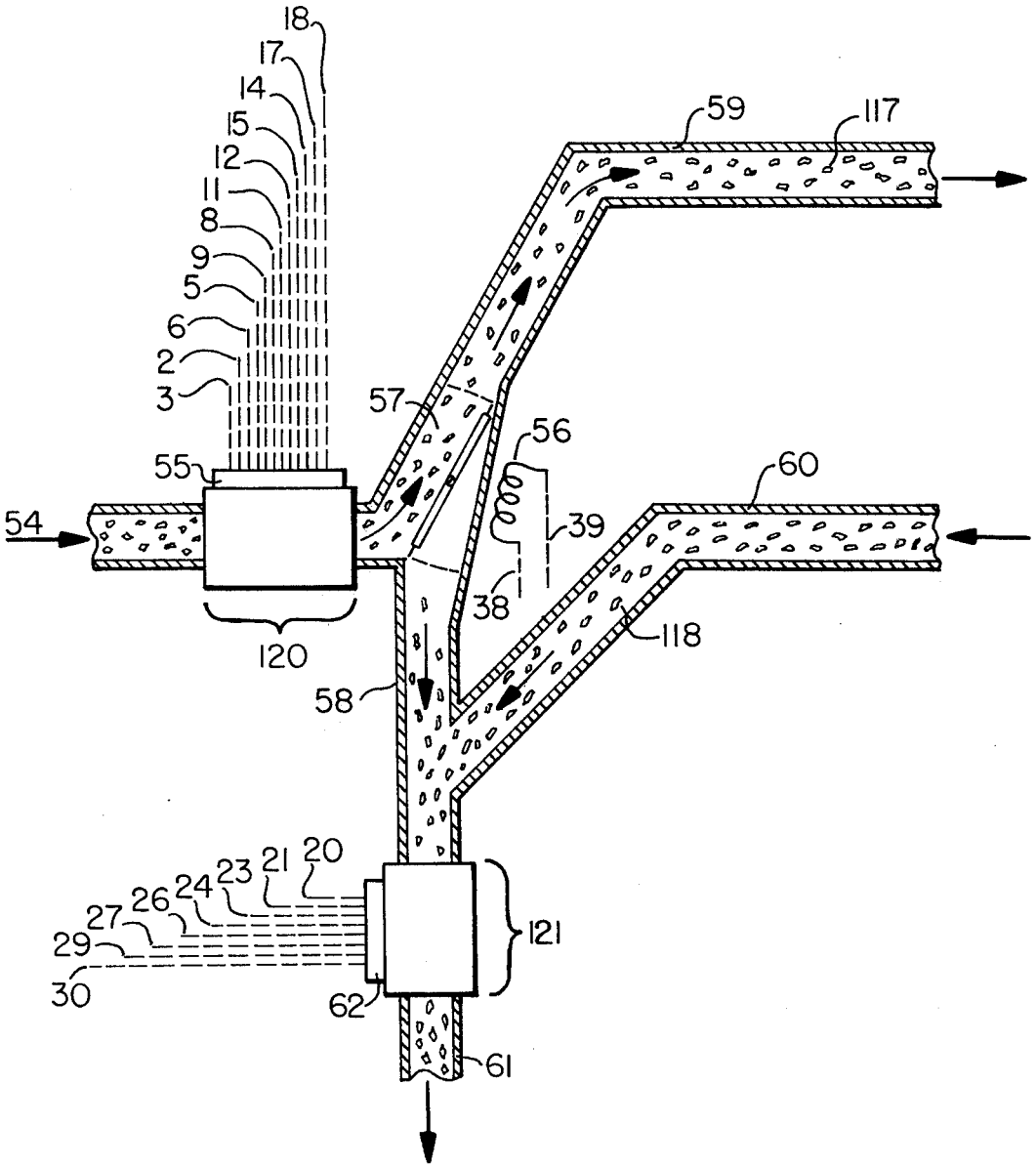
FIG. 2 is cross-sectional detail of the input-output manifold.
Figure 7:
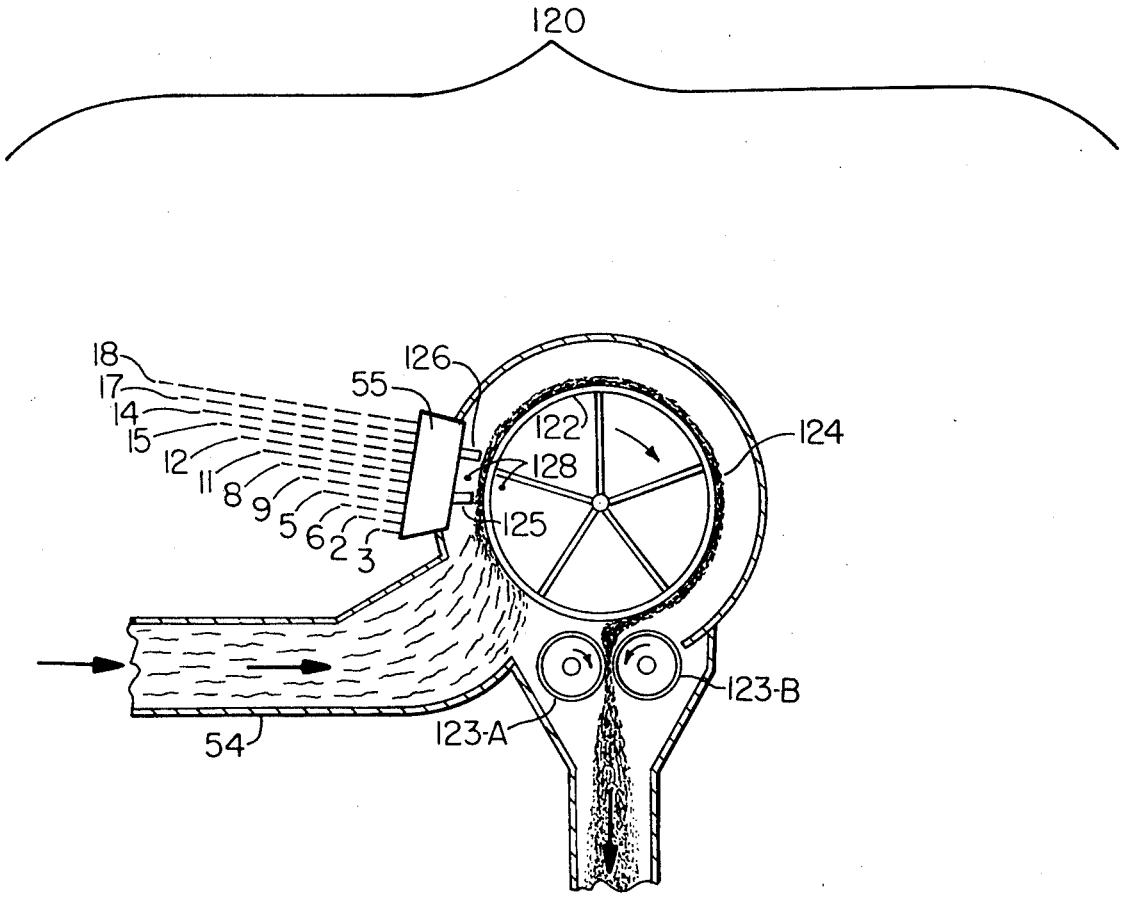
FIG. 7 is a detail showing the means for measuring the quality of the input cotton.

Referring now to FIGS. 1, 2, and 7 wherein lint cotton is received from the gin stand and enters through input duct 54 of input-output manifold section 40. A first measuring head 55 provides a means whereby a plurality of signals relating to a first set of the ginned fiber quality control measurements are taken and transmitted to individual measuring units. These control measurements include but are not limited to the lint moisture content, color of fiber, foreign matter level, fiber length, mass flow, etc. The instant invention typifies examples shown wherein the moisture signal is transmitted via electrical leads 2 and 3 to moisture measuring detector 1, the color signal via electrical leads 5 and 6 to color measuring detector 4, the foreign matter signal via leads 8 and 9 to foreign matter measuring detector 7, the fiber length signal via leads 11 and 12 to fiber length measuring detector 10, the lint mass flow rate signal via leads 14 and 15, to mass flow rate measuring detector 13, and any other desired signal via leads 17 and 18 to its signal detector 16. The number of quality or control factors recorded in this manner is not limited. The recorded signals or measurements from each individual detector are then internally fed to an attached first synchronizer unit 31 and all signals are combined in a manner such that a single output signal is generated and transmitted from the first synchronizer 31.

Typical operation of the measuring circuits might be such that each measuring detector would record its output as a 0 to 10 millivolt signal. These individual signals would then be combined in the synchronizer to obtain a single 0 to 10 millivolt synchronizer output, a consensus of the individual signals. Available in the synchronizer circuits are controls such that the influence exerted on the synchronizer output by the individual measuring detectors is adjustable. Experience has shown that under certain conditions one cotton quality should have greater control over the lint cleaner apparatus than another quality. Therefore, the individual quality control factors are evaluated, rated, and prioritized for importance and the synchronizer automatically controls by this pre-programmed priority of factors.

The signal synchronizer 31 output signal is then transmitted via electrical leads 32 and 33 to controller 37, the unit which makes the actual lint cleaner adjustments. Controller 37 via electrical leads 38 and 39 has control of directional valve 57 via electrical solenoid 56. For cottons already having the desired qualities controller 37 sets valve 57 in a position such that lint cotton 117 by-passes lint cleaning system 53 and passes via lint duct 58 into lint flue 61. For cottons requiring cleaning, directional valve 57 is automatically set in a position such that the cotton passes via duct 59 to lint cleaner 53. After passing through lint cleaner 53, cleaned cotton 118 is transported via duct 60 into lint flue 61 which is affixed to the exhaust end of said by-pass duct. No cotton will be trapped by the lint cleaner to this by-pass arrangement.

A typical operation and measurement of these individual parameters can be accomplished as follows: Lint cotton in duct 54 enters a first cotton quality measuring section 120 which consists of a rotating drum 122 and two feed rollers **123*a* and 123*b*. Thus the lint cotton is formed into a batt 124 upon which first measuring means 55 can make quality measurements. Moisture measuring probe 126, FIG. 7, is designed to contact cotton batting 124, obtain a moisture content signal and transmit the signal thru leads 2 and 3. Fiber length probe 125 obtains a small sample of fiber and measures the fiber length by light scanning and transmits this data through leads 11 and 12. A light scanning device in measuring head 55 scans cotton batt 124 and produces a signal relating to color and foreign matter. The color signal is transmitted through leads 5 and 6 and the foreign matter signal is transmitted through leads 8 and 9. The mass rate of flow is determined by means of taking a pressure differential reading across cottong batt 124. This is accomplished by locating pressure switch 128 on opposite sides of cotton batt 124. A pressure differential reading corresponding to the mass rate of flow is transmitted through leads 14 and 15. Cotton exhausted from section 120 passes on to lint directional valve 57**.

Foreign matter content measurements of raw cotton can be made using equipment such as the Outlook Cotton Trash Meter, Model 237. This is an optical-electronic instrument that can be used to measure the foreign-matter content in less than five seconds by scanning a sample area approximately four inches by five inches and gives two readings: the fraction of sample area occupied by trash, and a relative indication of the number of trash praticles. This is a product of Outlook Engineering, Corporation, Alexandria, Va.

Cotton color can be measured by a device such as the Nickerson-Hunter Cotton Colorimeter. This is an automatic device which measures cotton color rapidly and accurately and gives a close indication of the classer's grade designation. It provides an instrument measure of the color factor included in grade. Its measurement includes a reflectance value and a degree of yellowness term. With the instrument, color values for specific samples of cotton are compared with the color of the cotton in the official grade standards.

Fiber length can be measured by equipment such as the Digital Fibrograph instrument which produces an instrument measure of fiber length closely associated with staple length and also includes measures of fiber length distribution. The unit combs a parallelized test beard from a sample, and the Fibrograph instrument then photoelectrically scans the beard from the short fiber portion to the long fiber portion at the beard's extremity. The amount of light passing through the beard to the scanning photocell increases as the bulk of the fiber decreases and determines the length measurement obtained (Cotton Testing Service: Tests Available, Equipment and Techniques, and Basis for Interpreting Results. C & MS-82, U.S. Dept. Agr., May 1970).

Several companies manufacture systems which can continuously monitor and provide output signals based on the moisture content of cotton. These can measure the moisture content of fibers while still on the seed or be adapted to measure continuously the fiber moisture content in a moving lint batt. Two of these available apparatuses are the Fiber-Sentry Electronic Moisture Control, manufactured by the Hardwicke-Etter Co., Sherman, Texas, and the Moist-O-Graph Detector system manufactured by Minneapolis-Honeywell Regulator Co., Boston, Mass. The Hardwicke-Etter unit determines the moisture content of the cotton by the "capacitance" principle and the Honeywell unit uses the "resistance" method.

Figure 3:
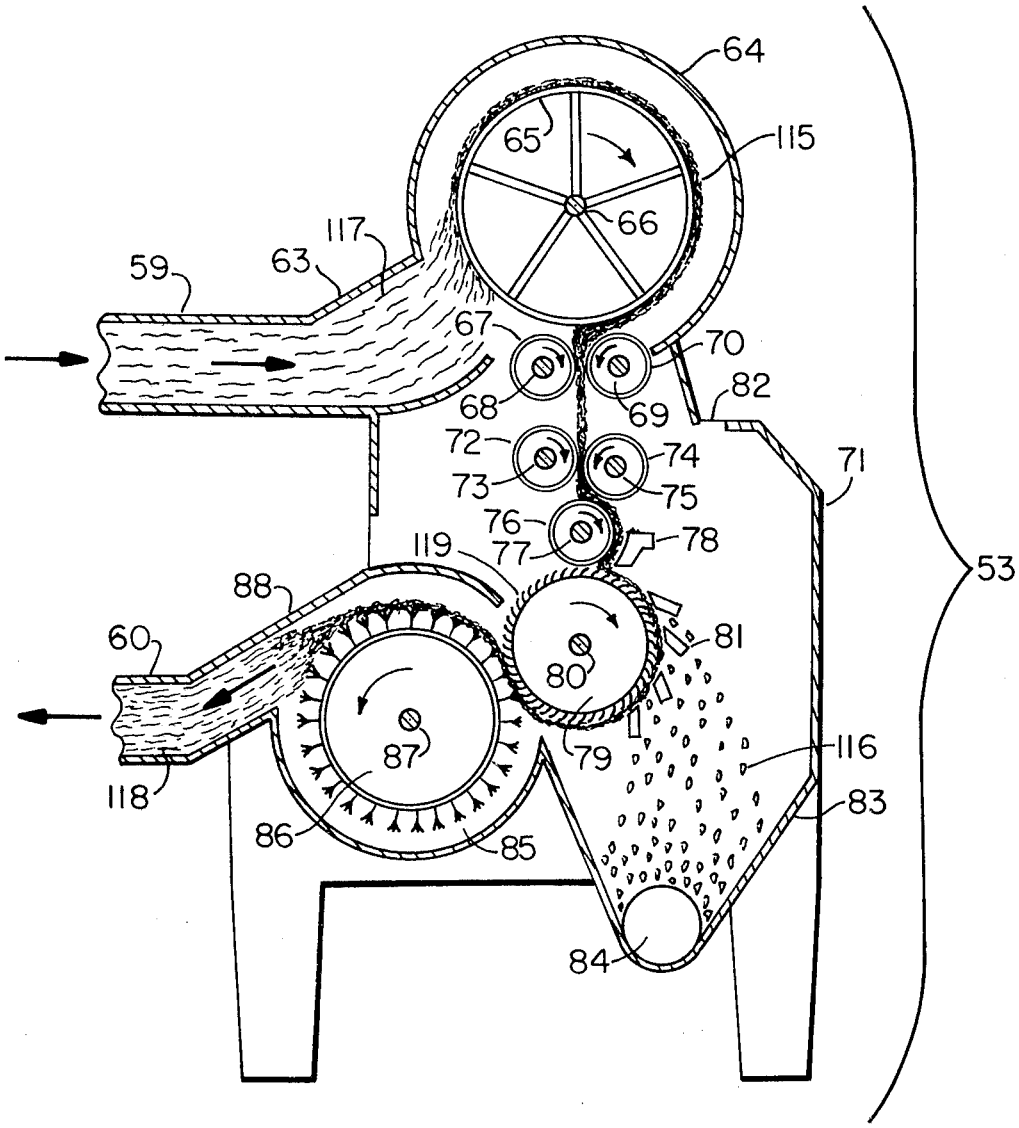
FIG. 3 is cross-section of a standard lint cleaner describing its salient internal components.

A new set of measurements of the quality of cotton which has by-passed or passed through the lint cleaner are taken in section 121 by means of a second measuring means or head 62 which is attached to section 121 to get an indication of what has been accomplished and to obtain still finer control of the cotton quality. A new color signal is transmitted via electrical leads 20 and 21 to a second color measuring detector 19, the foreign matter content signal via leads 23 and 24 to foreign matter detector 22, the fiber length signal via leads 26 and 27 to fiber length detector 25, and any other desired quality signal via leads 29 and 30 to its measuring detector 28. Waste material removed 116 (FIG. 3) by lint cleaning could be collected and weighed for each bale ginned. Then the ratio of waste weight to bale weight for the first bale ginned from a common stock could be used to made adjustments to obtain bale weight giving maximum bale value on the remainder of the stock.

Figure 8:
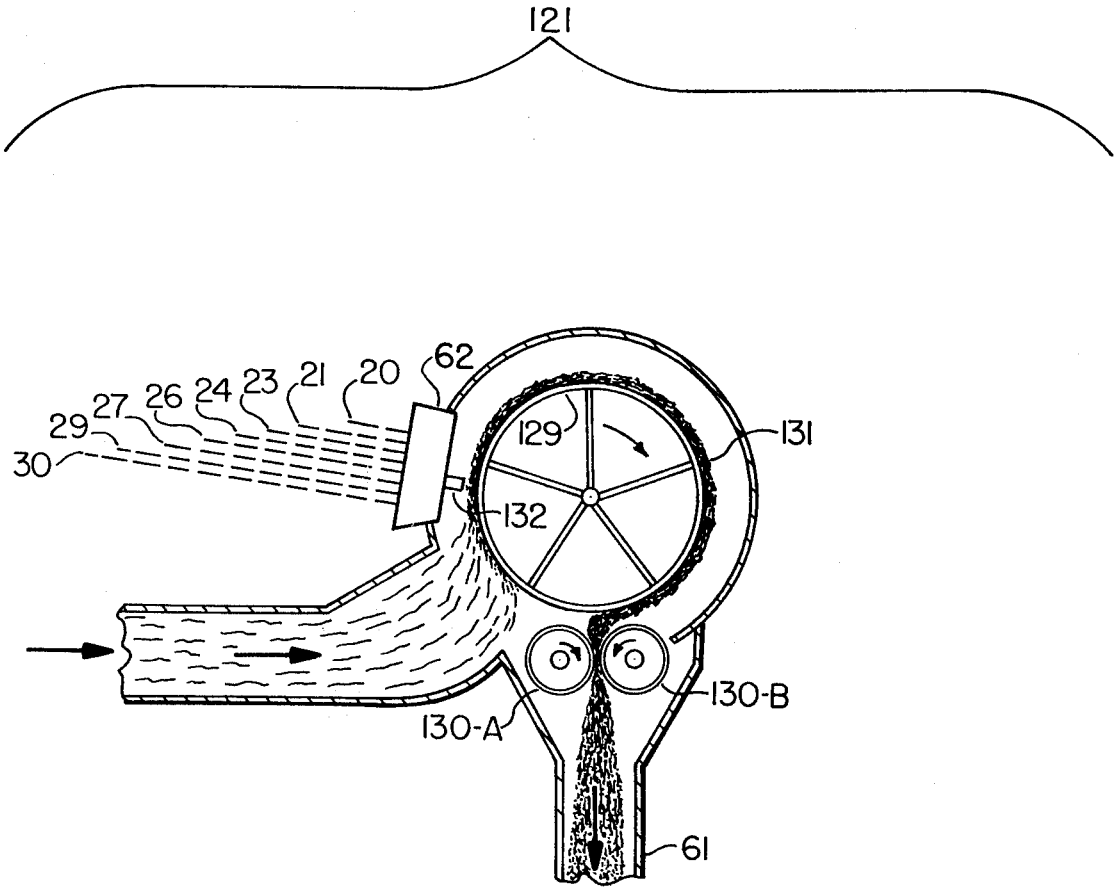
FIG. 8 is a detail showing the means for measuring the quality of output cotton.

A typical operation and measurement of these individual parameters by second measuring means 62 can be accomplished as follows: Lint cotton from ducts 58 and/or 60, FIGS. 2 and 8, enters a second quality measuring section 121 which consists of a rotating drum 129 and two feed rollers **130*a* and 130*b*. Thus the lint cotton is formed into a batt 131 upon which second measuring means 62 can make quality measurements. Fiber length probe 132 obtains a small sample of fiber and measures the fiber length by light scanning and transmits this data through leads 26 and 27. A light scanning device in measuring head 62 scans cotton batt 131 and produces a signal relating to color and foreign matter. The color signal is transmitted through leads 20 and 21 and the foreign matter signal is transmitted through leads 23 and 24. Cotton exhausted from section 121 passes out through duct 61. The instruments used to make cotton quality measurements at section 121 are the same as those described supra for section 120**.

Individual detected signals from detectors 19, 22, 25, and 28 (FIG. 1) are then transmitted to attached second synchronizer 34 where they are combined into a single output, similar to the manner discussed previously. The single output from second synchronizer 34 is then transmitted to controller 37 via electrical leads 35 and 36 as a feedback signal, providing a closed loop measuring circuit. Controller 37 is thus under the influence of a before and after lint cleaner measurement, except for the first few seconds of a bale when cotton is only at the before lint cleaner first measuring head and its measuring circuits have full control.

Lint cleaner 53 consists of cotton condenser 64 (FIG. 3) and cleaning unit 71. The quality of lint 117 passing through lint cleaner 53 is controlled by controlling the speed of all the rotating components within lint cleaner 53. Controller 37 (FIG. 1) accomplishes this by automatically controlling the speed of two varible speed motors 44 and 50. Condenser-feeder motor 44 is controlled by controller 37 by means of electrical leads 41 and 42 and variable speed regulator 43. Saw-cylinder motor 50 is controlled by means of leads 47 and 48 and variable speed regulator 49. Pulley 45 and belt 46 drive condenser 64 (FIG. 3) and feed works which includes compression rollers 72 and 74 feed roller 76 and feed plate 78 within cleaner 53 while multi-pulley 51 (FIG. 1) and multibelt 52 drive the saw-cylinder 79 and doffing brush 86.

Since cotton to be cleaned enters condenser 64 (FIG. 3) via transition section 63, cotton can be blown in, sucked in or a combination of both. Air suction is placed on the inside of rotating drum 65 drawing the air through the drum and depositing cotton on the drum and thus forms a batt 115 of cotton on drum 65's outer surface.

Condenser drum 65 rotates clockwise carrying cotton batt 115 around to wooden or metal doffing rollers 67 and 70. Doffing roller 67 rotates clockwise while doffing roller 70 rotates counterclockwise, doffing batt 115 from condenser drum 65. The outer surfaces of doffing rollers 67 and 70 are approximately ¼ inch apart and thus compress batt 115. Batt 115 is then fed from condenser 64 into the feed works of cleaning unit 71.

The feed works consist of one or more sets of compression rollers and a closely fitted feed roller and feed plate or bar. In the instant invention one set of compression rollers 72 and 74 are shown. Batt 115 is fed between rollers 72 and 74, compression roller 72 rotating clockwise and compression roller 74 rotating counterclockwise thereby producing a feeding and pulling effect on batt 115. The outer surfaces of rollers 72 and 74 are approximately ⅛ inch apart still further compressing batt 115. Compression rollers 72 and 74 feed batt 115 between feed roller 76 and stationary feed plate 78, feed roller 76 rotating clockwise to produce proper feeding. Spacing between feed roller 76 and feed plate 78 is approximately ⅛ inch. The rotating speeds of condenser drum 65, doffing rollers 67 and 70, compression rollers 72 and 74 and feed roller 76 are progressing slightly faster so that batt 115's linear speed increases only slightly to prevent breaking of batt 115.

Saw-cylinder 79 has a plurality of teeth on the outer surface which are spaced approximately 1/16 inch from feed roller 76 and bar mechanism 78. Saw teeth 119 seize fibers from cotton batt 115 as it is delivered to saw cylinder 79 which conveys fibers 118 to a discharge point adjacent to doffing brush 86. The tip speed of saw teeth 119 is a number of times greater than lint batt 115's speed and thus produces a combing action between the saw teeth 119 and batt 115. The ratio of saw teeth tip speed to batt speed is called "combing ratio." Saw-cylinder 79 rotating clockwise whips fibers 118 over the keen edge of a plurality of grid bars 81. Grid bar 81 edges are approximately 1/16 inch from saw tip. During this whipping action, the heavier particles of foreign matter 116 are dislodged from lint 118 and carried into trash bin 83 by centrifugal action. An air suction on duct 84 pulls ambient air into the cleaning unit through opening 82, giving an air wash across grid bars 81 and carries foreign matter 116 into exit duct 84. Doffing brush 86 located in chamber 85 rotates counterclockwise and bristle tips speed of brush 86 is faster than speed of raw tip 119 and doffs lint 118 from saw cylinder 79 and blows lint 118 through transition section 88 into duct 60 for transport to output manifold section 61 (FIG. 2).

Figure 4:
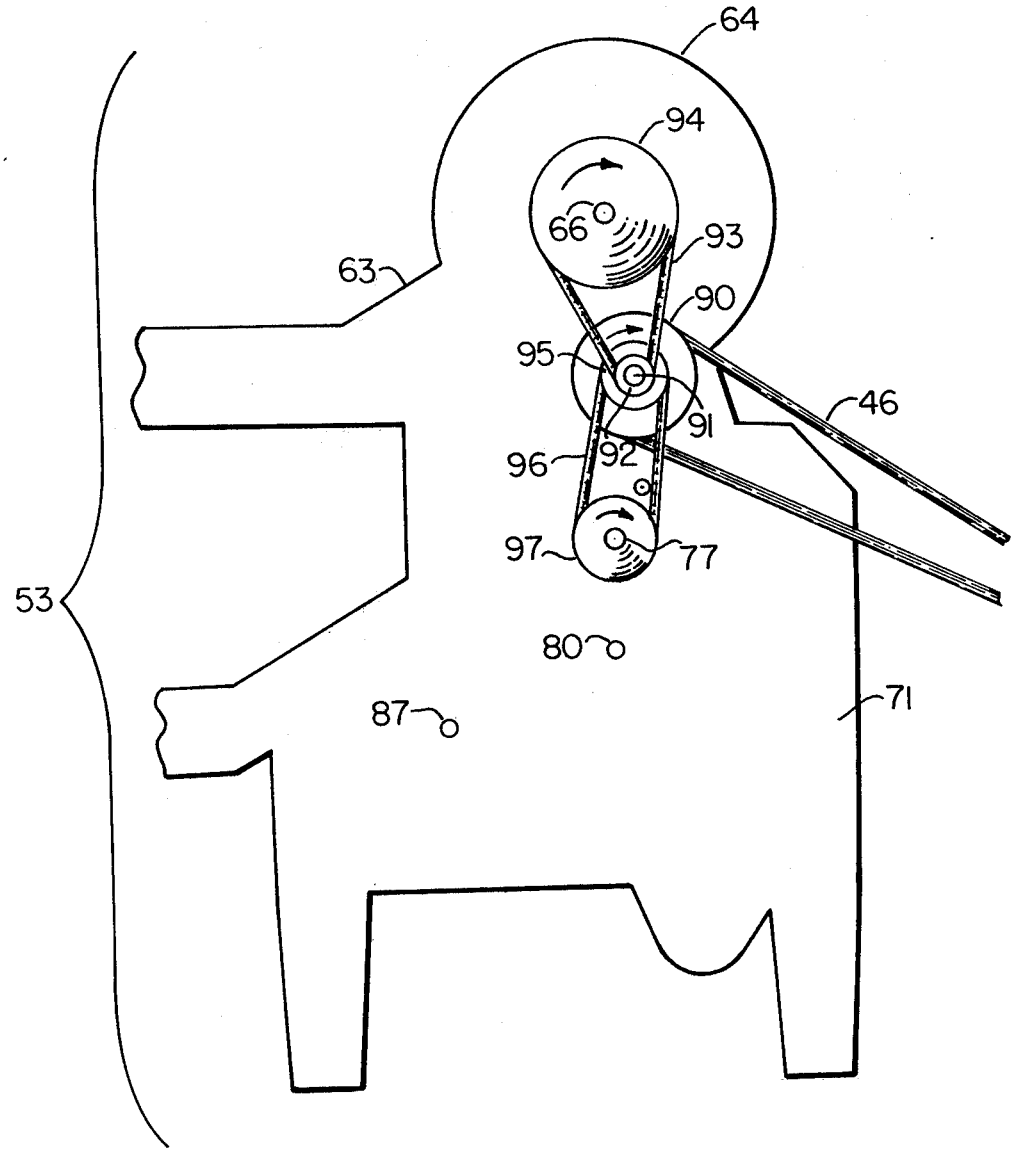
FIG. 4 is a left end view of the lint cleaner showing the driving mechanism for the condenser and the feed roller.

Referring to FIG. 4, wherein the left side of lint cleaner 53, unit belt 46 drives idler shaft 91 by means of idler pulley 90. Sprockets 92 and 95 are keyed to idler shaft 91 and rotate with it. Sprocket 92 by means of roller chain 93 drives driven sprocket 94 keyed to condenser drum shaft 66. Sprocket 95 by means of roller chain 96 drives driven sprocket 97 which is keyed to feed roller shaft 77.

Figure 6:
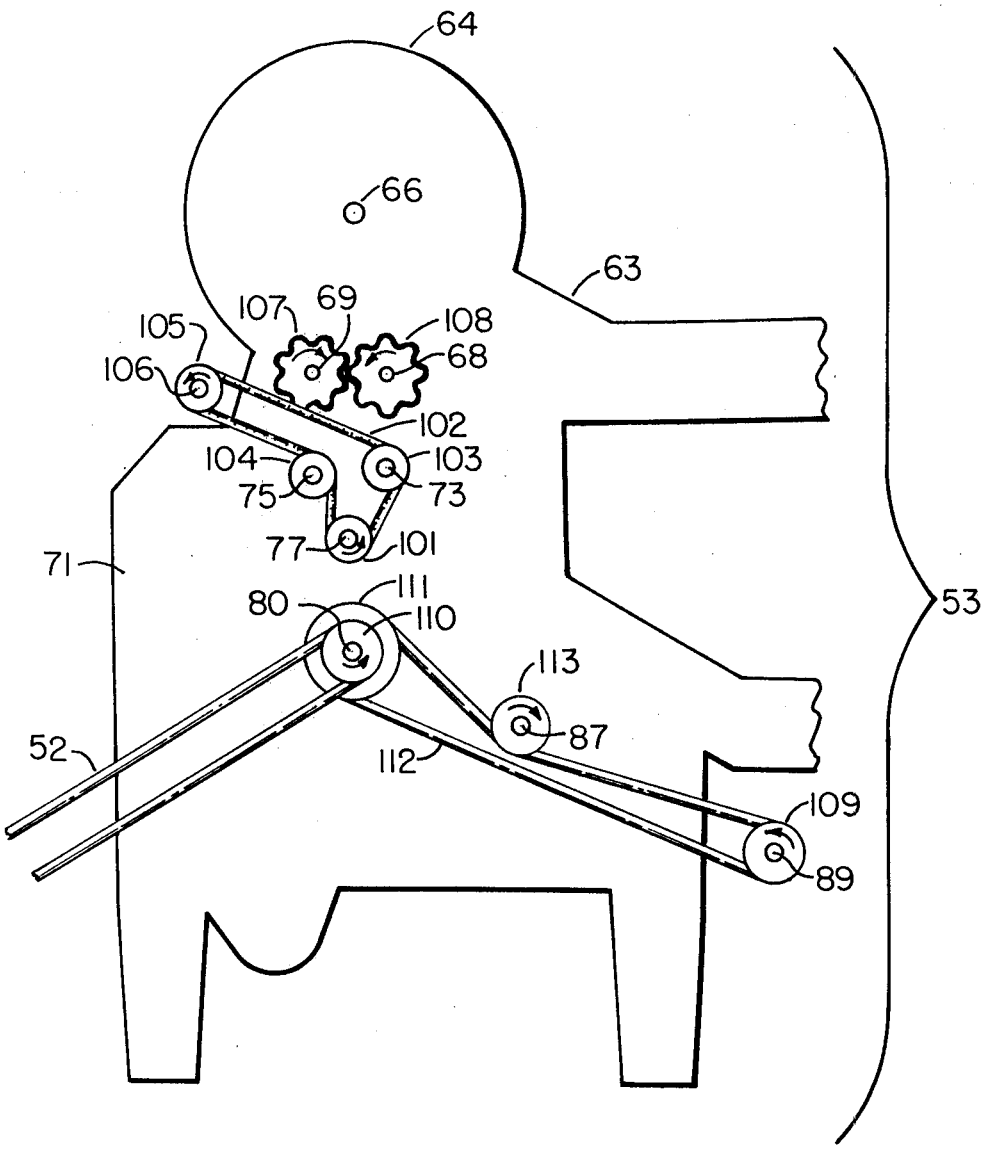
FIG. 6 is a right side view of the lint cleaning unit describing the drives for the saw cylinder, doffing brush, and part of the doffing roller and feed works drive which is driven on the right hand side.

From the right side of cleaner 53 (FIG. 6) unit sprocket 101 keyed to feed roller shaft 77 drives compression roller 72's shaft 73 and compression roller 74's shaft 75 by means of roller chain 102 and sprockets 103 and 104. The location of idler sprocket 105 and idler shaft 106 gives compression rollers proper rotational direction.

Figure 5:
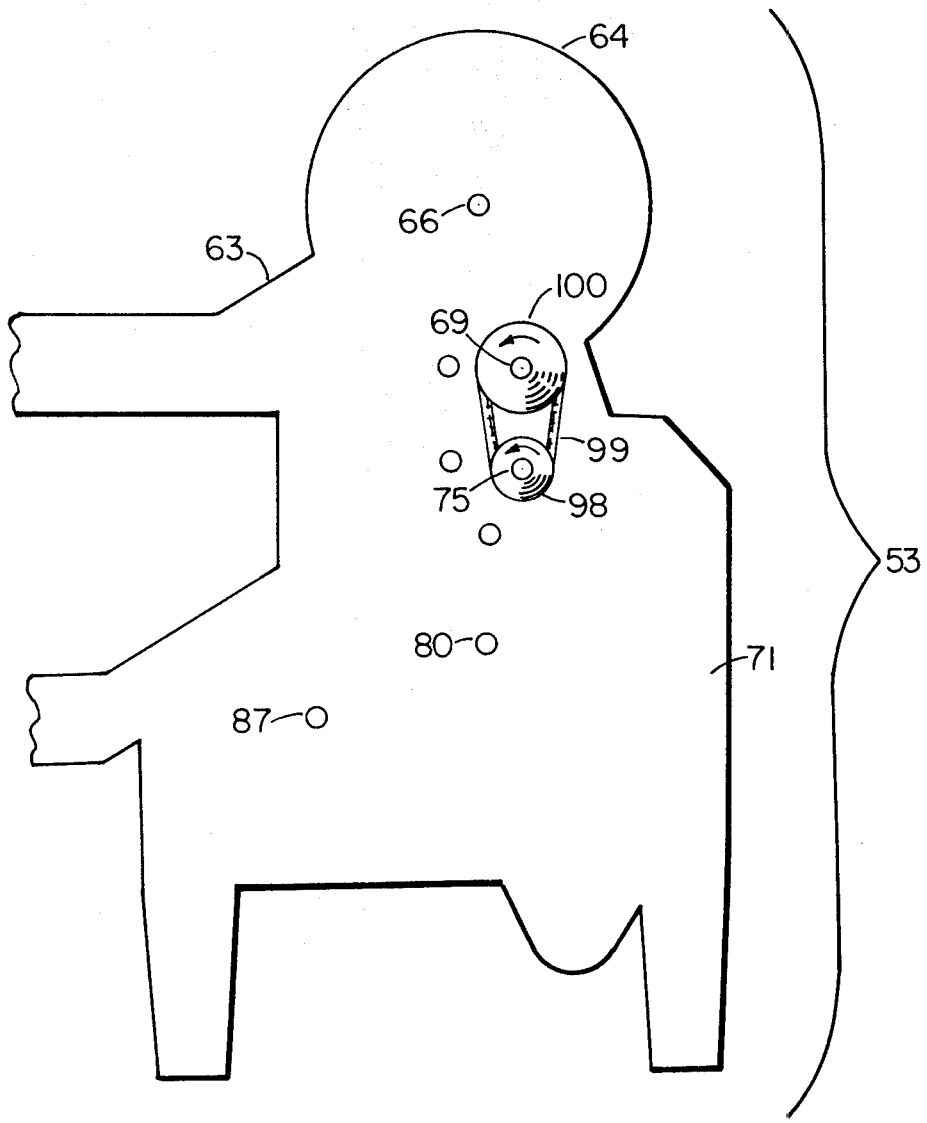
FIG. 5 is a left end view of the lint cleaner showing the driving mechanism for the doffing roller and the compression roller.

Sprocket 98 keyed to compression roller shaft 75 drives doffing roller 70's shaft 69 by means of roller chain 99 and sprocket 100(FIG. 5). Sprocket 100 is keyed to doffing roller shaft 69. Doffing roller shaft 69 transmits proper rotational power to doffing roller shaft 68 by means of meshed gears 107 and 108.

On the right side of cleaner 53 multi-belt 52 drives saw-cylinder shaft 80 by means of driven pulley 110. Pulley 111 is keyed to shaft 80 and drives doffing brush 86's shaft 87 by means of belt 112 and pulley 113. Location of idler shaft 89 and idler pulley 109 give proper directional rotation to shaft 87.

Control of variable speed motor 44 automatically regulates density of cotton batt 115 (FIG. 3), batt 115's linear speed and the combing action or combing ratio and rim speeds of feed roller 76. Control of variable speed motor 50, and thus saw-cylinder 79's speed, regulates the manner in which cotton is loaded on the saws, the combing ratio, and the amount of centrifugal action at grid bars 81. These actions all combine to give the desired quality characteristics described infra.

Although the figures show the measuring and control circuits by-passing or sending ling cotton 117 through one lint cleaner unit 53, the invention is designed to by-pass lint cleaner 53 or send lint cotton 117 through any desired number of lint cleaning units 53 or stages. Also, it is intended that the controls would control the speed of components in one or more of these cleaning units.

Three factors (grade, mass rate of flow, and moisture content) if measured and allowed to control the lint cleaning system would have a significant influence on the output of a gin plant. Tables 1, 2, and 3 delineate a typical means of controlling a three stage saw cylinder lint cleaning system in a gin plant, by using the three factors mentioned above.

The number of lint-cleaner stages is selected by the cotton's grade designation before lint cleaning as shown in table 1.

TABLE 1

| Number of lint cleaning stages selected by the classer's grade designation before lint cleaning | |
|---|---|
| Grade | Lint-cleaning stages |
| White: | |
| SLM | 0 |
| LM+ | 1 |
| LM | 1 |
| SGO+ | 1 |
| SGO | 2 |
| GO+ | 2 |
| GO | 2 |
| BG | 3 |
| Light Spotted: | |
| M | 0 |
| SLM | 1 |
| LM | 2 |
| Spotted: | |
| Sm | 0 |
| M | 1 |
| SLM | 2 |
| LM | 3 |

Cottons determined to be Strict Low Middling, White Middling Light Spotted, Strict Middling Spotted, or of higher grades would be by-passed around lint-cleaning system. Cottons with grades of Strict Good Ordinary Plus to Low Middling Plus White, Strict Low Middling Light Spotted, and Middling Spotted would be sent through one stage of saw-cylinder lint cleaning. Two stages of cleaning would be used on Good Ordinary to Strict Good Ordinary White, Low Middling Light Spotted, and Strict Low Middling Spotted cottons. Three lint cleaners are to be reserved for the Low Middling Spotted and Below Grade cottons.

Mass rate of flow measurements would control saw-cylinder shaft speed as shown by table 2.

TABLE 2

| Saw-cylinder speed controlled by the cotton's **mass** flow rate | |
|---|---|
| Flow rate[1] bales/ft cyl. | Saw tip speed, ft/min |
| 0.58 | 2,566 |
| .67 | 2,749 |
| .77 | 2,932 |
| .86 | 3,115 |
| .96 | 3,299 |
| 1.06 | 3,482 |
| 1.15 | 3,665 |
| 1.25 | 3,848 |
| 1.34 | 4,032 |

[1]One bale is equal to 480 pounds of lint cotton.

An increase in saw speed is to be programmed to a proportional increase in condenser and feeder works speed maintaining a constant saw tip to feed roller rim speed ratio. An increase of cotton flow from 0.58 to 1.34 bales per foot of saw-cylinder length would be accompanied by an increase in cylinder saw-tip speed from 2,566 to 4,032 feet per minute (table 2). This provides a control range of 3 to 7 bales per hour flow rate corresponding with 700 to 1,100 rev/min saw-cylinder speed for a saw cylinder 14 inches in diameter and 62.5 inches long. Adjustment of saw speed with change in mass flow rate maintains uniform batt thickness for consistent cleaning, and automatically compensates for changes in ginning rate and eliminates mechanical problems associated with lint-cleaner mass flow change.

The invention automatically controls combing ratio by raising or lowering the rotational speed of the condenser drum and feed works, and thus the feed roller based on the cotton moisture content as shown in table 3.

TABLE 3

| Combing ratio controlled by the cotton's **moisture** content | |
|---|---|
| Fiber moisture content, percent | Combing ratio[1] |
| 3 | 12 |
| 4 | 14 |
| 5 | 16 |
| 6 | 18 |
| 7 | 20 |
| 8 | 22 |
| 9 | 24 |

[1]Combing ratio is a ratio of speed (ft/min) of the tip of the combing saw to the speed (ft/min) of the rim of the feed roller.

As the fiber moisture content varies within a 3 to 9 percent range, combing ratio changes correspondingly within its 12 to 24 range.

I claim:

1. An apparatus for automatically controlling cotton quality in a lint cleaning apparatus comprising in combination the following:

(a) an input-output manifold section to receive lint cotton;

(b) an input duct affixed to said input-output manifold through which said lint cotton may enter said manifold section;

(c) a first measuring means attached to said input duct, said measuring means measuring a plurality of quality signals of said lint-cotton;

(d) a first synchronizing means communicating with said measuring means said synchronizing means combining the plurality of measured qualities into a single output signal;

(e) a controlling means communicating with said synchronizing means, said controlling means receiving the single output signal from said synchronizing means and adjusting a lint cleaning apparatus for proper cotton quality.

2. The apparatus of claim 1 including a means for by-passing the lint cleaning apparatus said means used for cotton which has the desired cotton qualities, said by-passing means comprising in combination:

(a) a directional valve located downstream of said measuring means, in said input duct;

(b) a by-pass duct adjoining said input duct, said by-pass duct located in a manner so as to form a juncture at said directional valve location and said input duct thereby allowing lint cotton to be passed through said input duct or said by-pass duct depending upon the position of said directional valve;

(c) a solenoid control device communicating with said directional valve and used to position said directional valve for flow of lint cotton;

(d) a lint flue affixed to an exhaust end of said by-pass duct to receive lint cotton from said by-pass duct and direct said lint cotton into further processing.

3. The apparatus of claim 1 wherein the first measuring means includes a color measuring device, a mass flow rate detector, a foreign matter measuring device, and a fiber length measuring device.

4. The apparatus of claim 1 including electrical leads to carry an electrical signal from the first measuring means to the first synchronizing means.

5. The apparatus of claim 1 further including electrical leads to carry the single output signal from the first synchronizing means to the controlling means.

6. The apparatus of claim 2 further comprising a second measuring means attached to said lint flue, said second measuring means measuring a plurality of lint-cotton qualities.

7. The apparatus of claim 6 wherein said second measuring means measure color, fiber length, foreign matter content, and a lint mass flow rate detector.

8. The apparatus of claim 7 further including a second synchronizing means communicating with said second measuring head to combine the plurality of measuring qualities of said second measuring head into a single output signal to the controlling means.

9. The apparatus of claim 8 including electrical leads to carry an electrical signal from the second measuring means to the second synchronizing means.

* * * * *